US006726611B2

(12) United States Patent
Hansen

(10) Patent No.: US 6,726,611 B2
(45) Date of Patent: Apr. 27, 2004

(54) DISPLAY PACKAGE AND METHOD OF MANUFACTURE

(75) Inventor: Jonathan C. Hansen, Grand Rapids, MI (US)

(73) Assignee: Display Pack, Inc., Grand Rapids, MI (US)

( * ) Notice: Subject to any disclaimer, the term of this patent is extended or adjusted under 35 U.S.C. 154(b) by 136 days.

(21) Appl. No.: 09/731,470

(22) Filed: Dec. 7, 2000

(65) Prior Publication Data

US 2001/0003114 A1 Jun. 7, 2001

Related U.S. Application Data

(62) Division of application No. 09/375,589, filed on Aug. 17, 1999, now abandoned.

(51) Int. Cl.[7] ..... B31B 1/60
(52) U.S. Cl. ..... 493/84; 493/128; 493/374
(58) Field of Search ..... 206/461, 471, 206/484, 464, 462, 467; 493/84, 128, 150, 374, 379

(56) References Cited

U.S. PATENT DOCUMENTS 2,787,552 A * 4/1957 Seiferth
2,873,023 A * 2/1959 Erickson
3,087,823 A * 4/1963 Hein et al.
3,172,768 A * 3/1965 Joosten et al.
3,202,277 A * 8/1965 Lewi
3,247,643 A * 4/1966 Bartelt
4,233,801 A * 11/1980 Watt ..... 53/453
4,278,693 A * 7/1981 Dingethal et al.
4,506,495 A * 3/1985 Romagnoli ..... 53/559
4,839,126 A * 6/1989 Griesdorn ..... 264/339
4,845,921 A * 7/1989 Miselli
5,735,404 A * 4/1998 Kumakura et al.
6,234,781 B1 * 5/2001 Hicks et al. ..... 425/384

OTHER PUBLICATIONS

Aqua Tab Face–Seal Blister Package.
Visual Packaging Systems Inc. Mock Clamshell Package.

* cited by examiner

*Primary Examiner*—Eugene Kim
(74) *Attorney, Agent, or Firm*—Warner Norcross & Judd LLP

(57) ABSTRACT

A blister package having a shaped blister flange and a correspondingly shaped backing. The flange and backing are non-planar, thereby permitting the width of the blister pocket while maintaining the area of contact between the blister flange and backing. The blister package is manufactured by the general steps of (a) producing a blister with a shaped flange, (b) locating the blister in a correspondingly shaped die, (c) producing a backing with a layer of heat activated adhesive, (d) locating the backing over the blister, and (e) applying heat and pressure to the backing and blister with a correspondingly shaped heated press.

10 Claims, 6 Drawing Sheets

DISPLAY PACKAGE AND METHOD OF MANUFACTURE

This is a divisional application of Ser. No. 09/375,589, filed Aug. 17, 1999 ABN.

BACKGROUND OF THE INVENTION

The present invention relates to packaging, and more particularly to blister packages and a method for manufacturing the same.

Blister packages are widely used in the industry to package articles for display during sale. Blister packages are desirable because they are relatively inexpensive to manufacture and to fill, and they allow the packaged article or articles to be viewed by the customer at the point of sale. Blister packages are available in a variety of styles. A conventional "face-seal" blister package 80 is shown in FIG. 1. A face-seal blister package typically includes a transparent (or translucent) blister 82 that is secured to a backing material 84, such as a paperboard panel. The blister is typically manufactured from PVC or PET, and is shaped to hold the article(s) to be packaged. For small articles, such as tacks or brads, the blister may define a simple rectangular void, while for larger articles, the blister may be shaped to match the contours of the article being packaged. In a conventional "face-seal" blister package construction, the blister 82 includes a pocket 86 and a peripheral flange 88. The flange 88 extends outwardly in a single plane to define a mounting surface for securing the blister 82 to the backing 84. The flange 88 is typically secured to the backing 84 by conventional methods, such a heat activated adhesive. In a common blister pack construction, the blister flange 88 is approximately one quarter of an inch in width. This will provide sufficient attachment between the blister 82 and backing 84 for many standard applications. The size of the flange 88 will, however, vary from application to application depending in large part on the size and weight of the article(s) being packaged, the type of adhesive used to secured the blister and backing, and the materials used to manufacture the backing and blister.

A second conventional package 80' is shown in cross-section in FIGS. 2 and 3. This type of package is referred to as a "mock clamshell" construction because it is designed to provide the appearance of a conventional clamshell package. The mock clamshell package 80' includes a blister 82' that is secured to a planar backing 84'. The blister 82' includes a planar major surface 92, a pocket 86' extending forwardly from the major surface 92, and a platform 90 that extends rearwardly from the periphery of the major surface 92. The major surface 92 is substantially coextensive with and secured to a paperboard backing 84'. The platform 90 extends rearwardly to emulate the appearance of a more expensive clamshell package.

These conventional blister package constructions suffers from a number of significant disadvantages. As best shown in FIGS. 1 and 2, the flanges 88 and 88' decrease the width of the pocket 86 and 86' for packages 80 and 80' of a given width, thereby reducing the volume of products that can be displayed in a given display area. For example, a conventional two and one half inch wide package includes a two-inch pocket and a quarter-inch flange. Because the flange extends along both sides of the package, the flange decreases the maximum width of the pocket by a total of one half of an inch. As a result, the pocket can be only 80 percent of the overall width of the blister package to incorporate the flange. This means that, in the lateral direction, twenty percent of the display area is for the most part wasted. In addition, the planar flange of a conventional blister package severely limits package design and is visually unappealing in many applications.

SUMMARY OF THE INVENTION

The aforementioned problems are overcome by the present invention wherein a blister package is provided with a shaped blister flange and a correspondingly shaped backing. The flange and backing are non-planar and are intersecured by corresponding non-planar tooling.

In a preferred embodiment, the present invention includes an angled blister flange and a correspondingly angled backing. The package is manufactured by providing a planar backing and a blister with an angled flange. The backing and blister are intersecured with conventional adhesives using a special die and heated press. The die and heated press are shaped to correspond with the angled blister flange. As the die and heated press are closed, the backing is pressed into the shape of the blister, giving the backing a peripheral margin that extends along an angle with the blister flange. Simultaneously, the heat from the heated press activates the adhesive coating on the backing thereby securing the backing to the blister along the blister flange. If desired, the shaping and sealing steps can be performed separately.

The present invention provides a simple and inexpensive blister package with reduced dimensions and an improved visual appearance. The shaped blister flange provides the ability to increase the size of the blister pocket available in a given amount of space. The size of the blister pocket can be increased over conventional planar blister packages without increasing the overall size of the package and without compromising the attachment area between the blister and backing. Further, the shaped blister flange provides for significant variety in the design and appearance of the package. Also, the contours or bends in the blister and in the backing significantly strengthen the overall construction of the package. This allows the thickness of both the blister and the backing to be reduced, thereby reducing the overall cost of the package.

These and other objects, advantages, and features of the invention will be readily understood and appreciated by reference to the detailed description of the preferred embodiment and the drawings.

DETAILED DESCRIPTION OF THE PREFERRED EMBODIMENT

The Blister Package

Figure 1:
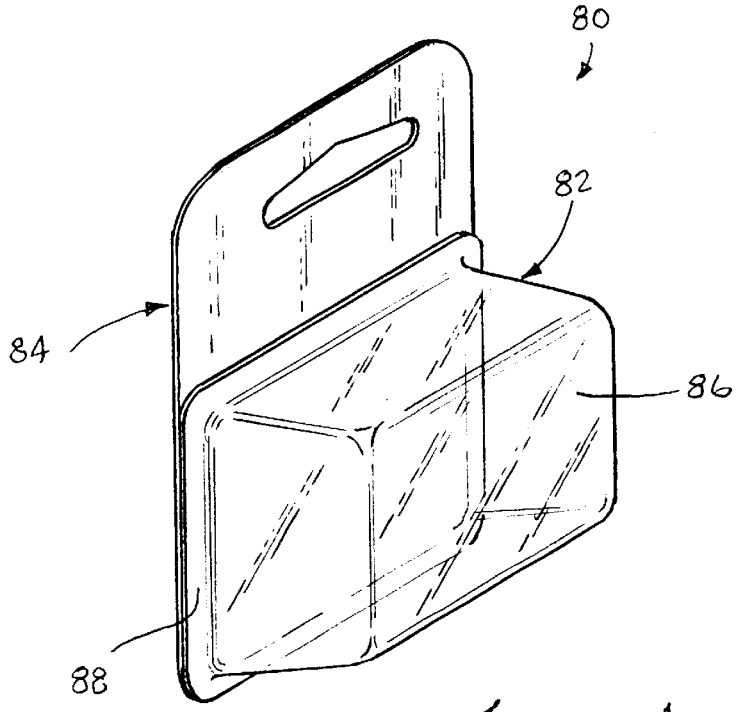
FIG. 1 (PRIOR ART)
FIG. 1 is a perspective view of a first prior art blister package.
Figure 2:
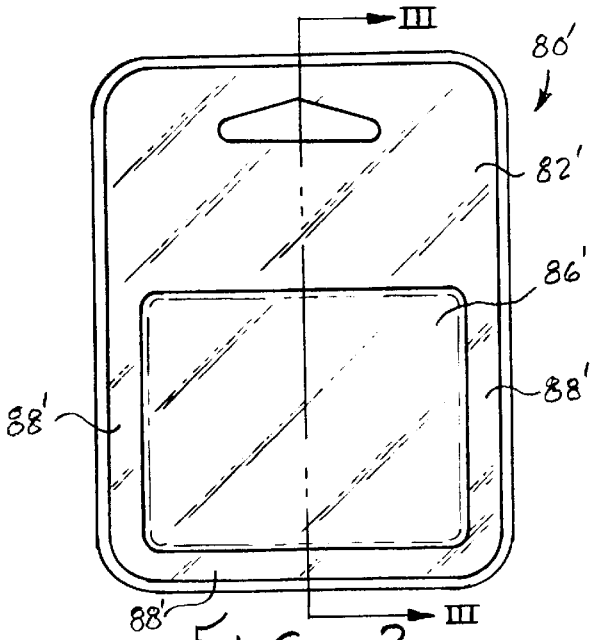
FIG. 2 (PRIOR ART)
FIG. 2 is a front elevational view of a second prior art blister package.
Figure 3:
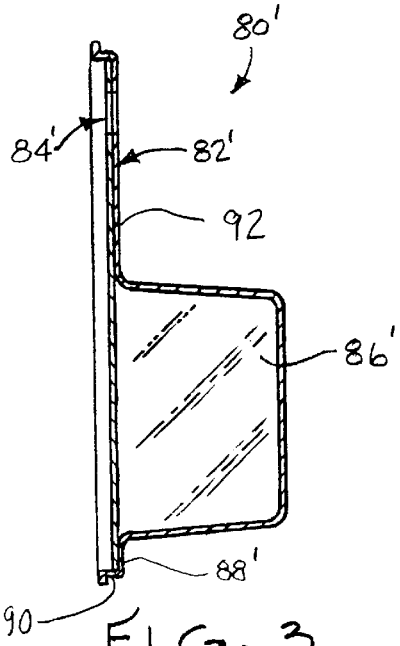
FIG. 3 (PRIOR ART)
FIG. 3 is a side elevational view of the second prior art blister package.
Figure 4:
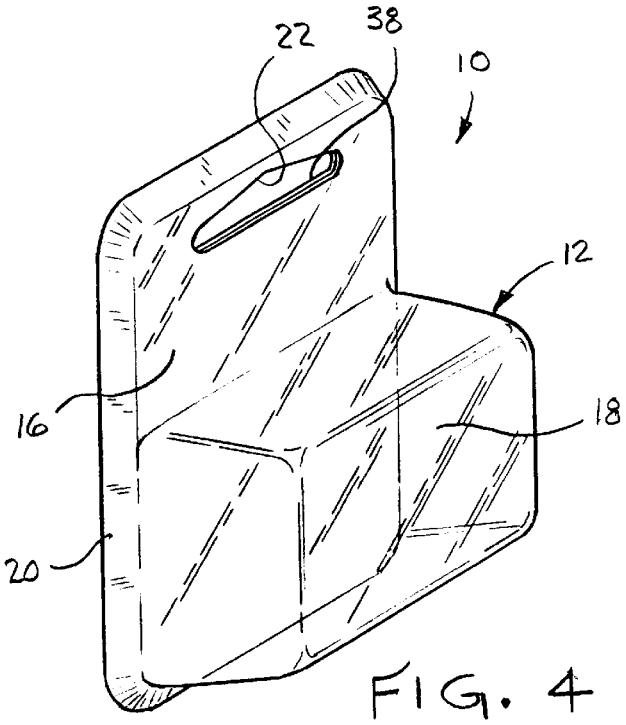
FIG. 4 is a perspective view of a blister package according to the present invention.
Figure 7:
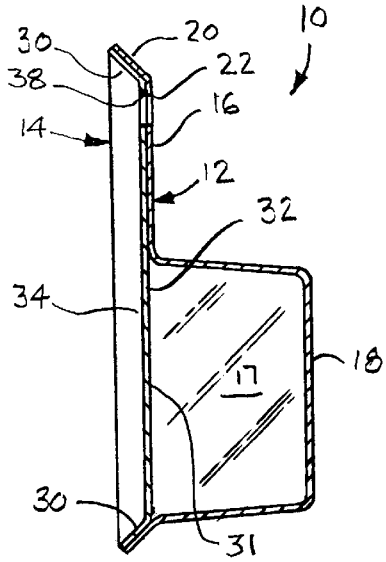
FIG. 7 is a sectional view of the package taken along line VII—VII of FIG. 5.
Figure 5:
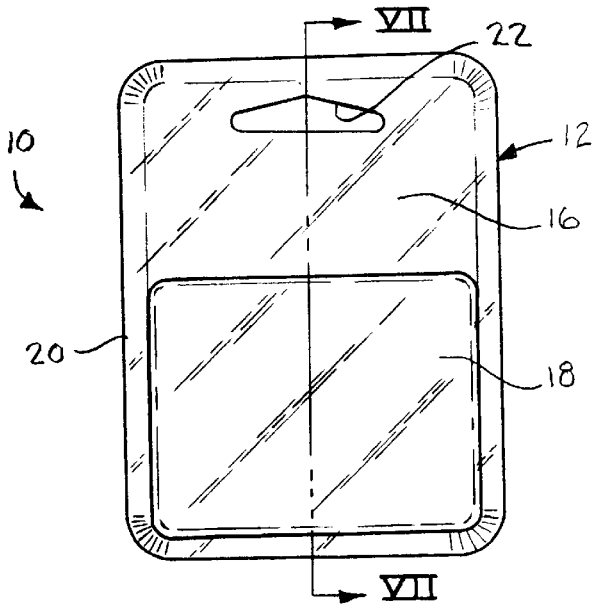
FIG. 5 is a front elevational view of the package.
Figure 6:
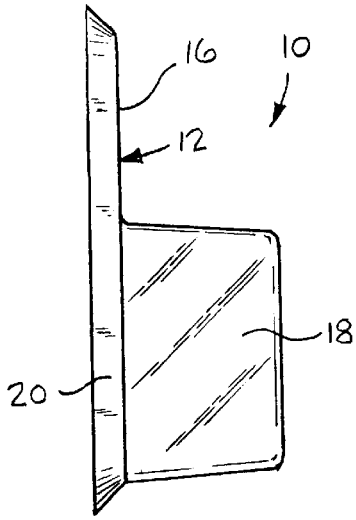
FIG. 6 is a side elevational view of the package.

A blister package according to a preferred embodiment of the present invention is shown in FIG. 4, and generally designated 10. The blister package 10 is designed to hold articles at the point of sale, and is typically discarded by the consumer after the article is removed. In some applications, the blister package will, however, be used as a storage container until the articles are exhausted (e.g. tacks or brads). The blister package 10 generally includes a blister 12 and a backing 14 (see FIG. 7). The blister 12 and backing 14 are intersecured to define an enclosed space 17 for holding the desired article or articles. For purposes of this disclosure, the terms "front," "back," "forward" and "rearward" are used herein to denote the corresponding directions with respect to the blister package when it is hanging for display at the point of sale. For example, the front surface of the blister package is the surface of the package facing the consumer when the package is on display. Further, the term "display plane" is used herein to denote a plane extending along the height and width of the blister when the package is on display. Typically, the display plane is a substantially vertical plane extending parallel to the shelf or rack that supports the package. Additionally, the term "shaped" is used herein to describe a non-planar or contoured component, whether including curved and/or differently angled portions.

The present invention will first be described in connection with a relatively simple blister package shown in FIGS. 4–7. The blister 12 is typically manufactured from a transparent or translucent polymer, such as polyvinyl chloride (PVC) or polyethylene terephthalate (PET). The blister 12 generally includes a major surface 16, a pocket 18 extending forwardly from surface 16 and a flange 20 extending rearwardly at an angle from the periphery of surface 16. The major surface 16 is typically planar and defines a hanging hole 22 for hanging the blister package 10 from virtually any standard display hook at the point of sale. In some applications, the major surface 16 may be eliminated and the flange 20 may extend directly and solely from the periphery of the pocket 18 (See FIG. 10). The hanging hole 22 is preferably located at the top center of the major surface 16. The size, shape and location of the hanging hole 22 will vary from application to application.

As noted above, the pocket 18 extends forwardly from the major surface 16 and, in the illustrated embodiment, is generally rectangular in shape. The pocket 18 can, however, be of virtually any desired size and shape (e.g. FIGS. 8 and 10) to define an appropriate space for containing the article or articles to be packaged. The pocket 18 is configured to display the article or articles on a display plane, which generally extends substantially vertically and substantially perpendicularly to the line of sight of consumers when the package is displayed during normal use.

The flange 20 extends at an angle rearwardly from the periphery of the surface 16. The angle of the flange 20 will vary from application, but in the preferred embodiment, the angle is approximately 60 degrees from the plane defined by the major surface 16. As described below in connection with various alternative embodiments, the flange 20 may be shaped or contoured to provide more complex package designs. The major surface 16 may be non-planar or may be eliminated in some applications. In such applications, the angle of the flange 20 is measured from the display plane (not shown). As will be readily apparent to one skilled in the art, the overall width of the package will vary with changes in the angle and width of the flange 20. The overall width of the package can be determined by the formula: $[2\times(F\times COS\ A)]+W$, where F is the width of the flange 20, A is the angle of the flange 20 with respect to the major surface 16, and W is the width of the major surface 16. The angle formed in the blister 12 significantly improves the strength and rigidity of the blister 12 and of the assembled blister package 10. Accordingly, the angled flange 20 permits the use lighter weight materials than would be required for similar packages with a planar flange. For standard applications, the blister 12 is approximately 0.012, 0.015 or 0.018 of an inch in thickness (12, 15 or 18 gauge).

The backing 14 is a generally planar sheet of stock material that is secured to the rear of the blister 12 to enclose the article or articles within the blister pocket 18. The backing 14 includes a front surface 32, a back surface 34 and, preferably, a hanging hole 38. The hanging hole 38 is aligned and typically corresponds in shape with the hanging hole 22 of the blister 12. The backing is preferably manufactured from any of a variety of paperboard materials readily available in the industry. As described in more detail below, the backing 14 will be shaped to conform to the blister flange 20 during the manufacturing process. In the illustrated embodiment, the backing 14 includes a peripheral margin 30 surrounding a major portion 31. The peripheral margin 30 is bent backward during manufacture to correspond with the shape of the blister flange 20 (See FIG. 7). The width and height dimensions of the backing 14 are selected to match the dimensions that the blister 12 would have had if the blister flange 20 was not angled (e.g. width of the blister pocket plus actual width of the flanges). This will allow the backing 14 to be substantially coextensive with the blister flange 20 after the backing 14 has been shaped to conform to the angled blister flange 20. The angle or bend introduced into the backing 14 during manufacture will significantly improve the strength and rigidity of the backing 14 and of the assembled blister package 10. In the preferred embodiment, the backing 14 is approximately 0.014 of an inch in thickness (14 point). It should be noted that conventional constructions using a planar backing might typically require a thickness of 0.021 of an inch thick (21 point) for similar applications. The backing 14 further includes a layer of adhesive (not shown) extending over its front surface 32. The adhesive (not shown) is preferably a conventional heat activated adhesive that is selected for its ability to adhere to the backing 14 and the blister 12. If desired, the adhesive coating can be applied only to the peripheral portion 30 of the backing 14 where the blister flange 20 and the backing 14 are in contact. This will typically provide a sufficient attachment between the backing 14 and blister 12.

Figure 15:
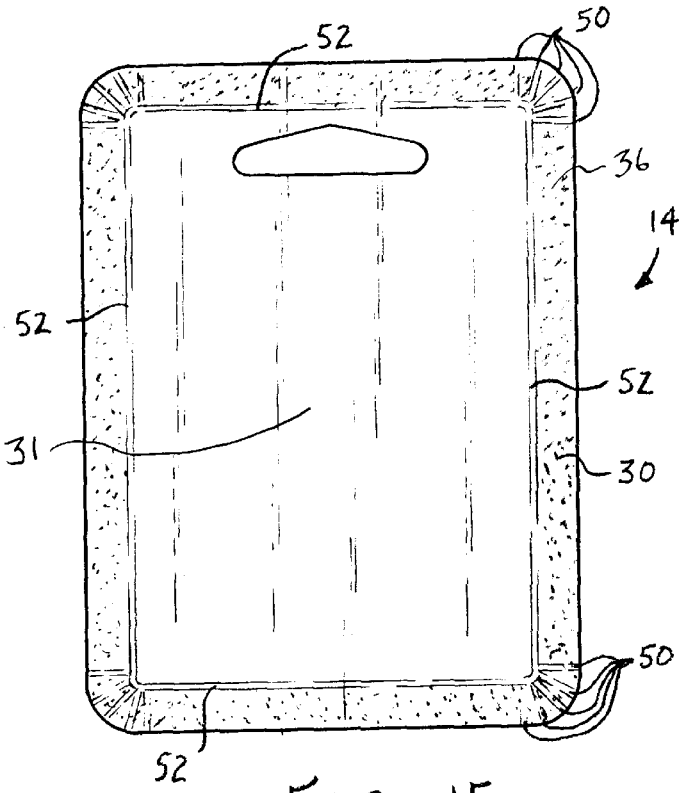
FIG. 15 is a top plan view of the backing showing the score lines.

In the preferred embodiment, the backing 14 is provided with score lines that facilitate shaping of the backing 14. For example, referring now to FIG. 15, the backing 14 can include radial score lines 50 in the corners to facilitate bending of the corners. Similarly, the backing 14 can include score lines 52 to facilitate bending of the peripheral margin 30 rearwardly from the major portion 31. The location and arrangement of score lines will vary from application to application.

Manufacture and Assembly

Figure 13:
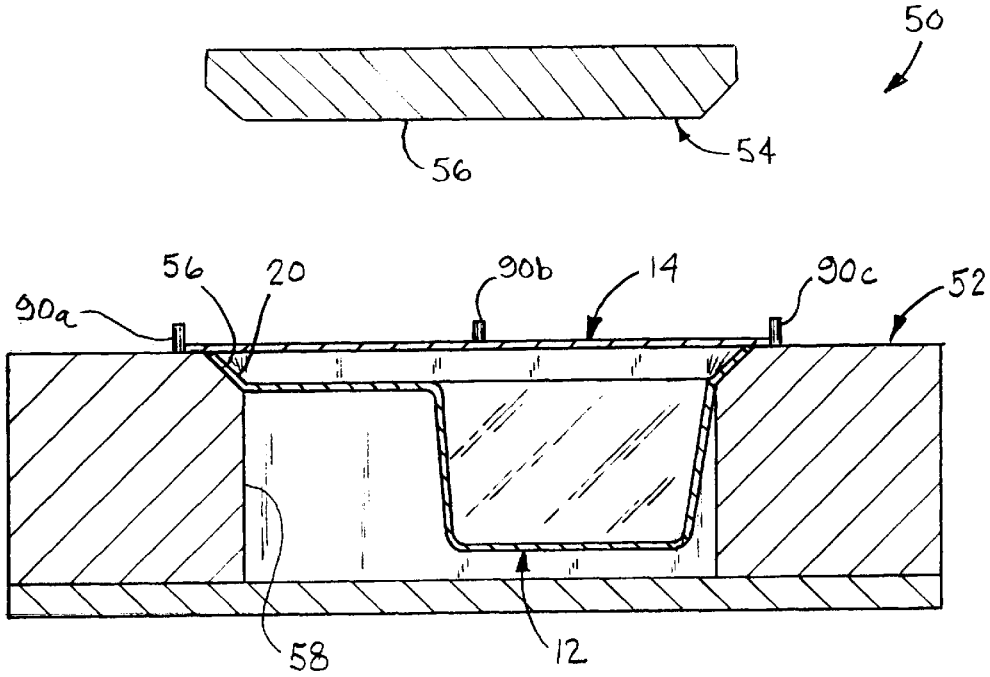
FIG. 13 is a sectional view of the blister and backing in an open die and heated press assembly.
Figure 14:
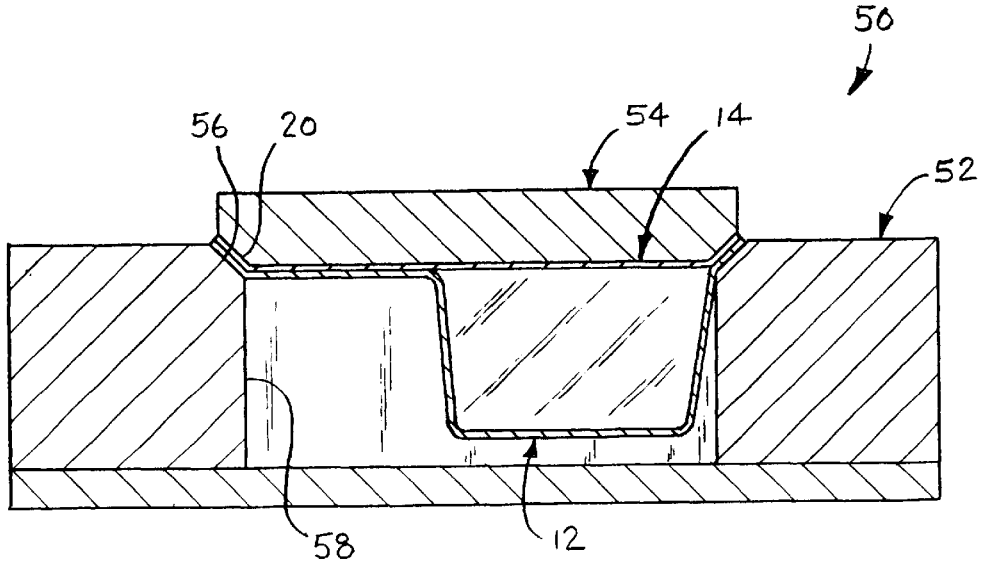
FIG. 14 is a sectional view of the blister and backing in a closed die and heated press assembly.

The blister package 10 is manufactured and assembled using a die and heated press specially 50 adapted to function with an angled blister flange 20. As shown in FIGS. 13 and 14, the die and heated press assembly 50 includes a die 52 and a heated press 54 (platen). The die 52 defines an opening 58 designed to receive the blister 12. The periphery 56 of the opening 58 is angled to correspond with the angle of the blister flange 20. The heated press 54 is mounted upon an actuation mechanism (not shown) for moving the heated press 54 with respect to the die 52. The heated press 54 includes a bottom surface 56 that is shaped and dimensioned to match with the opening 58 of the die 52, taking into account the thickness of the blister 12 and backing 14. The heated press 52 is heated to the appropriate temperature for activating the specific adhesive applied to the backing 14. The temperature as well as the pressure and dwell time of the press will vary from application to application.

Figure 12:
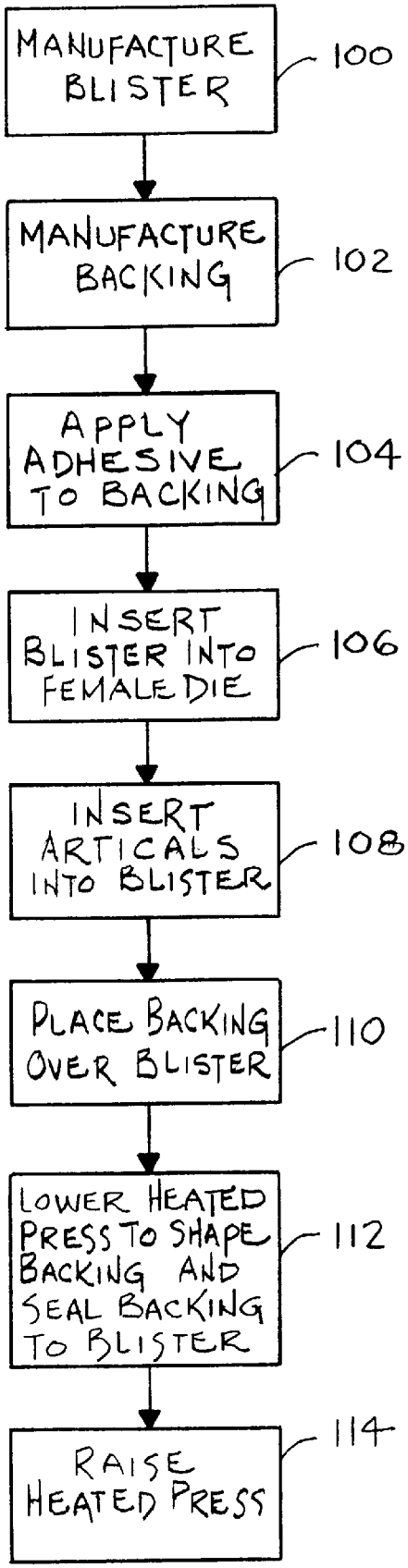
FIG. 12 is a flow chart of the general steps involved in manufacturing the blister package.

The manufacturing process will be described with reference to the flow chart of FIG. 12. The blister 12 is manufactured 100 using conventional techniques and apparatus. For example, the blister 12 can be manufactured using conventional vacuum forming techniques and apparatus. In the preferred embodiment, the blister 12 is manufactured from 12 gauge PVC sheet stock. Typically, a sheet of the appropriate stock material is vacuum formed into an array of blisters. The sheet is the is then cut to separate the array into individual blisters.

The backing 14 is also manufactured 102 using conventional techniques and apparatus, such as printing, coating and diecutting presses. In the preferred embodiment, the backing 14 is manufactured from 14 point paperboard stock. The adhesive 36 is applied 104 to the backing 14 with a conventional applicator, such a roller, and allowed to dry. The adhesive is typically applied around the periphery of the backing 14, for example, around the peripheral one-quarter inch of the backing 14. The disposition and type of adhesive will vary from application to application as desired. Typically, the layer of adhesive is applied to a sheet of stock material and then the sheet is cut into a plurality of individual backings. Any desired score lines, such as score lines 50 and 52, can be formed in the backing 14 during the die cutting step.

As shown in FIG. 13, the blister 12 is inserted 106 upside down into the opening 58 with its flange 20 engaging the angled periphery 56 of the opening 54. This step can be performed manually or it may be automated using conventional machinery. Once the blister 12 is positioned, the article or articles to be packaged are inserted 108 into the pocket 18. This step is typically automated through the use of conventional product feeding machinery (not shown), but may also be performed manually. The backing 14 is then placed 110 on top of the die 52 over the blister 12 with its front surface 32 down. The backing 14 is preferably registered using conventional apparatus, such as stationary or retractable locating pins 90*a–c* protruding from the die 52.

Once the backing 14 is properly registered with respect to the blister 12, the heated press 54 is lowered 112 into the die opening 54 (See FIG. 14). The heated press 54 reshapes the backing 14 forcing it down into the die opening 54. Typically, the heated press 54 may cause the corners of the backing 14 to wrinkle and or crease slightly as it conforms to the shape of the die opening 54. The heated press 54 applies heat and pressure to the blister 12 and backing 14, thereby activating the adhesive 36 and sealing the blister 12 to the backing 14. The heated press 54 is then raised 114 to provide access to the finished package. For mass production, the die may include multiple die openings so that multiple packages can be formed and sealed in a single actuation of the heated press assembly.

Alternative Embodiments

Figure 8:
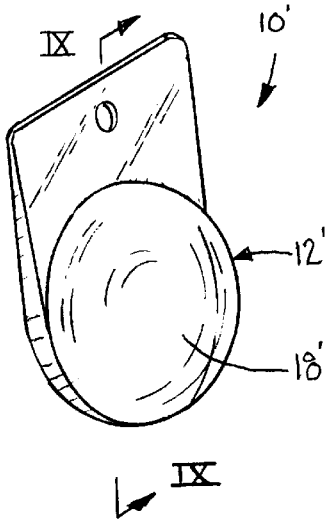
FIG. 8 is perspective view of an alterative blister package.
Figure 9:
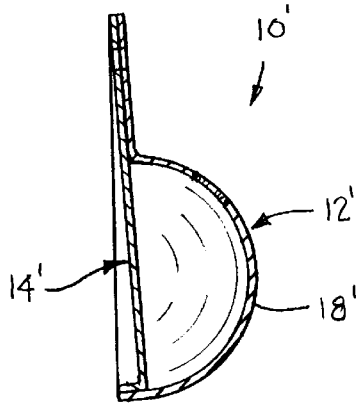
FIG. 9 is sectional view of the alternative blister package taken along line IX—IX of FIG. 8.

A variety of alternative blister packages in accordance with the present invention are shown in FIGS. 8–11 and 15–16. These alternative embodiments illustrate the flexibility of the present invention by showing variously shaped packages that provide increased pocket width and improved aesthetic appearance while maintaining the required surface area of contact between the blister and the backing. FIGS. 8 and 9 show a blister package 10' in which the blister 12' includes a hemispherical pocket. In this embodiment, a backing 14' with a curved bottom edge is secured to the blister 12'. As perhaps best shown in FIG. 9, the pocket flows smoothly and continuously into the flange 20'. The blister flange 20' tapers off to provide the package 10' with a substantially planar upper portion 56.

Figure 10:
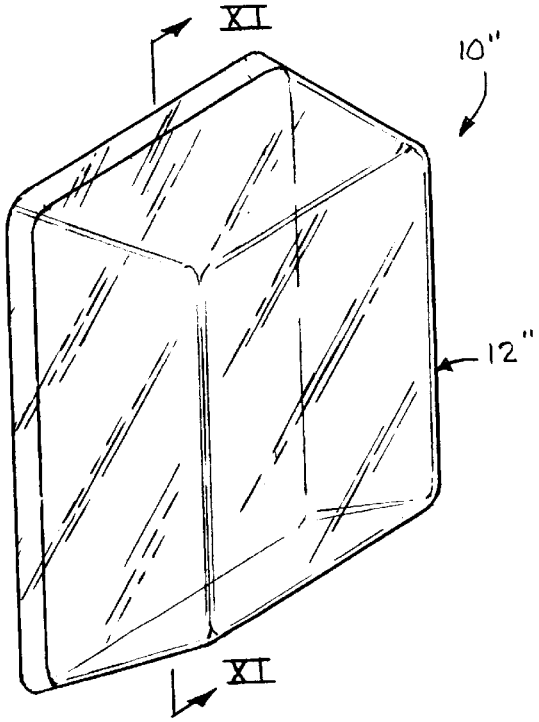
FIG. 10 is perspective view of a second alterative blister package.
Figure 11:
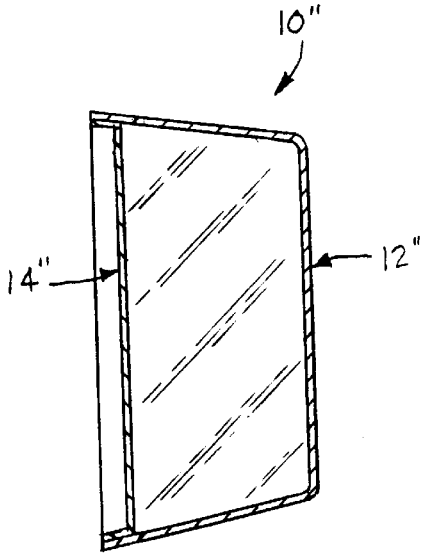
FIG. 11 is sectional view of the second alternative blister package taken along line XI—XI of FIG. 10.

FIGS. 10 and 11 show a blister package 10" including a blister pocket 18 "that extends to all four outer edges of the package". The blister pocket 18" includes four sides that are inclined at the same angle as the flange 20". In this embodiment, a rectangular backing 14" is secured to the blister 12". The backing 14" conforms to the shape of the flange 20" during manufacture.

Figure 18:
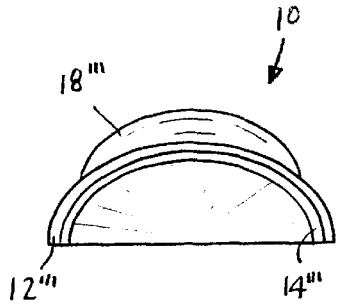
FIG. 18 is a bottom plan view of the third alternative blister package.
Figure 17:
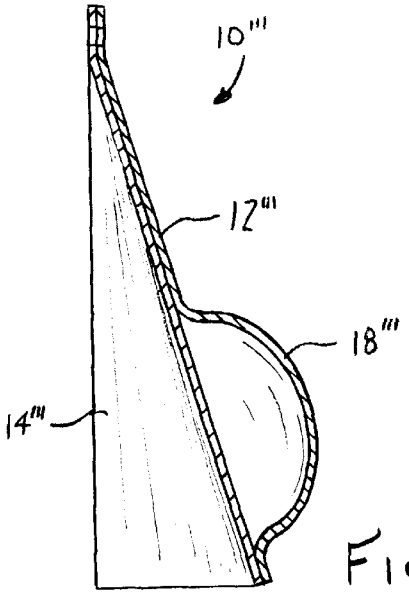
FIG. 17 is sectional view of the third alternative blister package taken along line XVII—XVII of FIG. 16.
Figure 16:
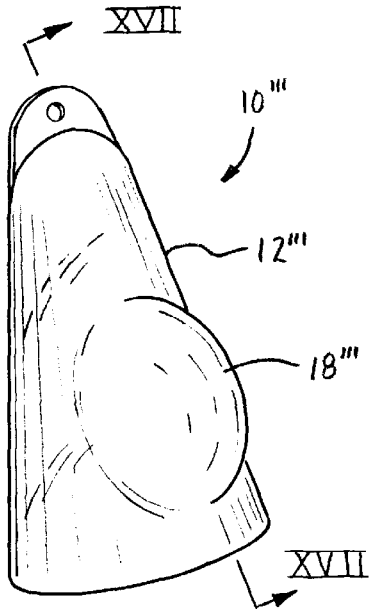
FIG. 16 is perspective view of a third alterative blister package.

FIGS. 16–18 show yet another alternative blister package 10''' including a curved blister 12''' and backing 14'''. Although the blister 12''' and backing 14''' are curved, they terminate in a horizontal plane at the bottom of the package 10'''. As a result, the blister 12''' and backing 14''' function as a pedestal to provide a free-standing package. The blister pocket 18''' is substantially hemispherical in the illustrations, but may obviously be shaped or contoured as desired. The curve in the blister 12''' and backing 14''' may be produced during the heat press stage of manufacture by pressing the blister 12''' and backing 14''' into the desired shape and then intersecuring them. Additionally or alternatively, depending on the application, the blister 12''' can be formed (e.g. blow molded) with a certain degree of curvature. In some applications, it may be desirable to form the blister 12''' with the degree of curvature desired in the completed package 10''' while in other applications, it may be desirable to form the blister 12''' with a lesser degree of curvature. The blister 12''' and backing 14''' are typically sealed together using heat activated adhesive (not shown) around the periphery of the package 10''', for example, along a peripheral one-quarter inch of the blister 12''' and backing 14'''. Obviously, the disposition and type of adhesive will vary from application to application as desired. For example, additional adhesive (not shown) may be disposed between the blister 12''' and backing 14''' in a line surrounding the pocket 18'''. This additional adhesive will help to resist separation of the blister 12''' and backing around the pocket 18''' and to retain small articles in the pocket 18'''.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A method of manufacturing a blister package, comprising the steps of:

producing a rigid blister defining a pocket and a nonplanar flange having a nonplanar first shape;

producing a rigid planar backing including a peripheral portion;

placing the blister in a die defining a die opening and having a shape corresponding to the nonplanar first shape, whereby the flange of the blister is supported by the die;

placing the backing atop the blister and aligned with the flange;

closing a press onto the die and backing, the press having a shape corresponding to the first shape causing at least the peripheral portion of the backing to conform to the first shape so that the backing is reconfigured from being planar to having at least a peripheral portion having the nonplanar first shape; and intersecuring the flange of the blister and the peripheral portion of the backing.

2. The method of claim 1 wherein said step of producing a backing includes the step of applying a heat-activated adhesive to the backing.

3. The method of claim 2 wherein said intersecuring step includes the steps of:

aligning the backing and the blister; and applying heat and pressure to the backing and the blister simultaneously to activate the heat-activated adhesive.

4. The method of claim 3, wherein the step of closing a press on the die and backing and the step of applying heat and pressure are performed simultaneously.

5. The method of claim 4 wherein said step of applying heat and pressure includes lowering a heated press onto the die, the heated press including a bottom surface shaped to correspond with the opening of the die taking into account a thickness of the blister and backing.

6. A method of manufacturing a blister package, comprising the steps of:

producing a rigid blister defining a pocket and including a nonplanar flange having a nonplanar first shape;

producing a rigid planar backing including a peripheral portion;

placing the blister in a die defining a die opening having a shape corresponding to the nonplanar first shape;

placing the backing in the die atop the blister; and closing a press onto the die and backing, the press having a shape corresponding to the nonplanar first shape causing at least the peripheral portion of the backing to conform to the nonplanar first shape; and intersecuring the flange and the peripheral portion of the backing whereby at least the peripheral portion is maintained in the nonplanar first shape.

7. The method of claim 6 wherein said step of producing a backing includes the step of applying a heat-activated adhesive to the backing.

8. The method of claim 7 wherein said intersecuring step includes the steps of:

aligning the backing and the blister; and applying heat and pressure to the backing and the blister simultaneously to activate the heat-activated adhesive.

9. The method of claim 8 wherein said step of applying heat and pressure includes lowering a heated press onto the die, the heated press including a bottom surface shaped to correspond with the opening of the die taking into account a thickness of the blister and backing.

10. The method of claim 1 wherein said step of producing a backing is further defined as die cutting a planar backing.

* * * * *